US009364836B2

(12) United States Patent
Williamson et al.

(10) Patent No.: US 9,364,836 B2
(45) **Date of Patent: *Jun. 14, 2016**

(54) METHOD AND APPARATUS FOR REMOVING METALLIC MATTER FROM AN OIL WELL CIRCULATING COMPLETION FLUID STREAM

(71) Applicant: PETROLEUM SPECIALTY RENTAL, LLC, Morgan City, LA (US)

(72) Inventors: Pat Williamson, Morgan City, LA (US); Steve Callegari, Lafayette, LA (US); Steve Callegari, Jr., Lafayette, LA (US); Raphael Fontenot, Lafayette, LA (US); Homer Boudreaux, Bayou Vista, LA (US); Larry Foley, Lafayette, LA (US)

(73) Assignee: PETROLEUM SPECIALTY RENTAL, LLC, Morgan City, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/305,590

(22) Filed: Jun. 16, 2014

(65) Prior Publication Data

US 2015/0041401 A1 Feb. 12, 2015

Related U.S. Application Data

(63) Continuation of application No. 12/789,233, filed on May 27, 2010, now Pat. No. 8,753,517.

(60) Provisional application No. 61/182,406, filed on May 29, 2009.

(51) Int. Cl.

| | |
|---|---|
| ***E21B 21/06*** | (2006.01) |
| ***B03C 1/02*** | (2006.01) |
| ***B03C 1/30*** | (2006.01) |

(52) U.S. Cl.

CPC ... *B03C 1/02* (2013.01); *B03C 1/30* (2013.01); *E21B 21/065* (2013.01); *B03C 2201/18* (2013.01); *B03C 2201/20* (2013.01)

(58) Field of Classification Search

CPC ..... E21B 21/06; E21B 21/063; E21B 21/065; E21B 41/005; E21B 43/40; B03C 1/02; B03C 1/28; B03C 1/284; B03C 1/286; B03C 1/30; B03C 2201/18; B03C 2201/20; B03C 2201/28

See application file for complete search history.

(56) References Cited

U.S. PATENT DOCUMENTS

| | | | |
|---|---|---|---|
| 2,792,115 | A | 5/1957 | Medearis |
| 3,143,496 | A | 8/1964 | Maretzo |

(Continued)

*Primary Examiner* — David C Mellon

(74) *Attorney, Agent, or Firm* — Garvey, Smith, Nehrbass & North, L.L.C.; Charles C. Garvey, Jr.; Vanessa M. D'Souza

(57) ABSTRACT

A method and apparatus for removing metallic material from a circulating well fluid stream provides a treatment vessel that is divided into first and second sections. Each of the sections includes a magnetic field that can be in the form of one or more magnets. In one embodiment, multiple magnets are provided in each of the sections. Manifolds attach to an influent and to an effluent of the treatment vessel. Each manifold enables selective transfer of fluid to either of the selected sections. Similarly, discharge of circulating fluid can be from either of the sections via a discharge manifold. The treatment vessel enables continuous treatment by valving fluid flow so that only one section need be used at a time in order that the other section could be serviced for removing collected metallic material from the magnetic field or from the magnets.

11 Claims, 14 Drawing Sheets

(56) References Cited

U.S. PATENT DOCUMENTS

| | | | | |
|---|---|---|---|---|
| 3,498,455 | A | 3/1970 | Kirby, III | |
| 3,713,499 | A | 1/1973 | Arscott et al. | |
| 3,966,590 | A | 6/1976 | Boom et al. | |
| 4,030,558 | A | 6/1977 | Morris | |
| 4,319,989 | A | 3/1982 | Wyland et al. | |
| 5,660,723 | A * | 8/1997 | Sanderson | 210/90 |
| 5,740,919 | A | 4/1998 | Stowe | |
| 5,944,195 | A | 8/1999 | Huang et al. | |
| 6,354,386 | B1 | 3/2002 | Ruttley | |
| 6,902,066 | B2 | 6/2005 | Yang | |
| 8,753,517 | B2 | 6/2014 | Williamson et al. | |
| 2006/0016732 | A1 | 1/2006 | Franzreb et al. | |
| 2007/0138103 | A1 | 6/2007 | Klatt | |
| 2008/0264607 | A1 * | 10/2008 | Hebert | 165/95 |
| 2011/0186523 | A1 | 8/2011 | Williamson et al. | |

* cited by examiner

METHOD AND APPARATUS FOR REMOVING METALLIC MATTER FROM AN OIL WELL CIRCULATING COMPLETION FLUID STREAM

CROSS-REFERENCE TO RELATED APPLICATIONS

This is a continuation of U.S. patent application Ser. No. 12/789,233, filed 27 May 2010 (issuing as U.S. Pat. No. 8,753,517 on 17 Jun. 2014), which claims benefit of U.S. Provisional Patent Application Ser. No. 61/182,406, filed May 29, 2009, each of which is incorporated herein by reference and priority of each is hereby claimed.

Priority of U.S. Provisional Patent Application Ser. No. 61/182,406, filed May 29, 2009, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method and apparatus for removing metallic matter (e.g. metal shavings, metal parts, iron, iron oxide and like metallic material from a flow stream of circulating oil well fluid, such as completion fluid.

2. General Background of the Invention

Magnets have been used to remove metal from a flow stream of oil well drilling mud. Examples of commercially available magnets can be seen at the Stacey Oil Services, Ltd. website (www.staceyoil.com) and the Ceesan website (www.ceesan.net). Such magnets are also known in the industry as "ditch magnets". Some patents have issued for ditch magnets. One such patent is U.S. Pat. No. 3,498,455. Other possibly relevant patents are listed chronologically in the following table.

TABLE

| Pat. No. | TITLE | ISSUE DATE |
|---|---|---|
| 2,792,115 | Selective Quantity Metering Dispenser For Granular Material | May 14, 1957 |
| 3,498,455 | Ditch Magnet | Mar. 03, 1970 |
| 3,713,499 | Method and Apparatus for Treating Drilling Mud | Jan. 30, 1973 |
| 3,966,590 | Magnetic Ore Separator | Jun. 29, 1976 |
| 4,030,558 | Wear Determination of Drilling Bits | Jun. 21, 1977 |
| 4,319,989 | Magnetic Separator | Mar. 16, 1982 |
| 5,740,919 | Magnetic Separator | Apr. 21, 1998 |
| 5,944,195 | Method for Separation of Solids from Drilling Fluids by Magnetic Separation and Centrifugation | Aug. 31, 1999 |
| 6,354,386 | Apparatus for Retrieving Metal Objects from a Wellbore | Mar. 12, 2002 |
| 2006/0016732 | High Gradient Magnetic Separator | Jan. 26, 2006 |
| 2007/0138103 | Magnetic Separation in Fluids | Jun. 21, 2007 |

Cuttings that have been retrieved from a magnet that was placed in an oil and gas well circulating fluid stream can provide information that is beneficial to oil and gas well operators. These collected cuttings may indicate casing wear during ordinary drilling operations, pipe wear, or any other factor which may be economically detrimental to the well or production.

Time is an important factor in oil and gas well drilling. The cost of drilling is rising. With drilling, rig rates as expensive as they are, a small part of time saved can equate to significant savings. Present oil and gas well drilling rates can be as high as $125,000 to $600,000 per day. Thus, any procedure or apparatus that shortens the time for handling the magnet and/or its debris can be a significant savings in money.

BRIEF SUMMARY OF THE INVENTION

The present invention provides a method of removing metallic material from an oil well circulating fluid stream using a magnetic field.

The method includes the providing of a vessel which holds multiple magnetic fields or magnets in multiple locations. Each of the locations has at least one magnetic field.

In one embodiment, each magnetic field is in the form of a magnetized bar. The magnetic fields are placed in the locations or sections so that circulating fluid flows through each section in a selected fashion.

In one embodiment, one section receives circulating fluid over time. The first section is then valved to halt fluid flow. At about the same time, a second section is opened to fluid flow so that the magnetic field in the second section is able to remove magnetic material from the circulating fluid flow stream.

In one embodiment, the magnetic material accumulates in the magnetic field or on the magnet over time.

In one embodiment, the magnetic material that is collected is removed from the magnetic field from time to time.

In the preferred embodiment, when one of the sections is closed so that fluid flow is circulating through the second section, metallic material is removed from the section that is not circulating fluid flow.

In one embodiment, a pressurized arrangement enables removal of metal from a pressured flow stream.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
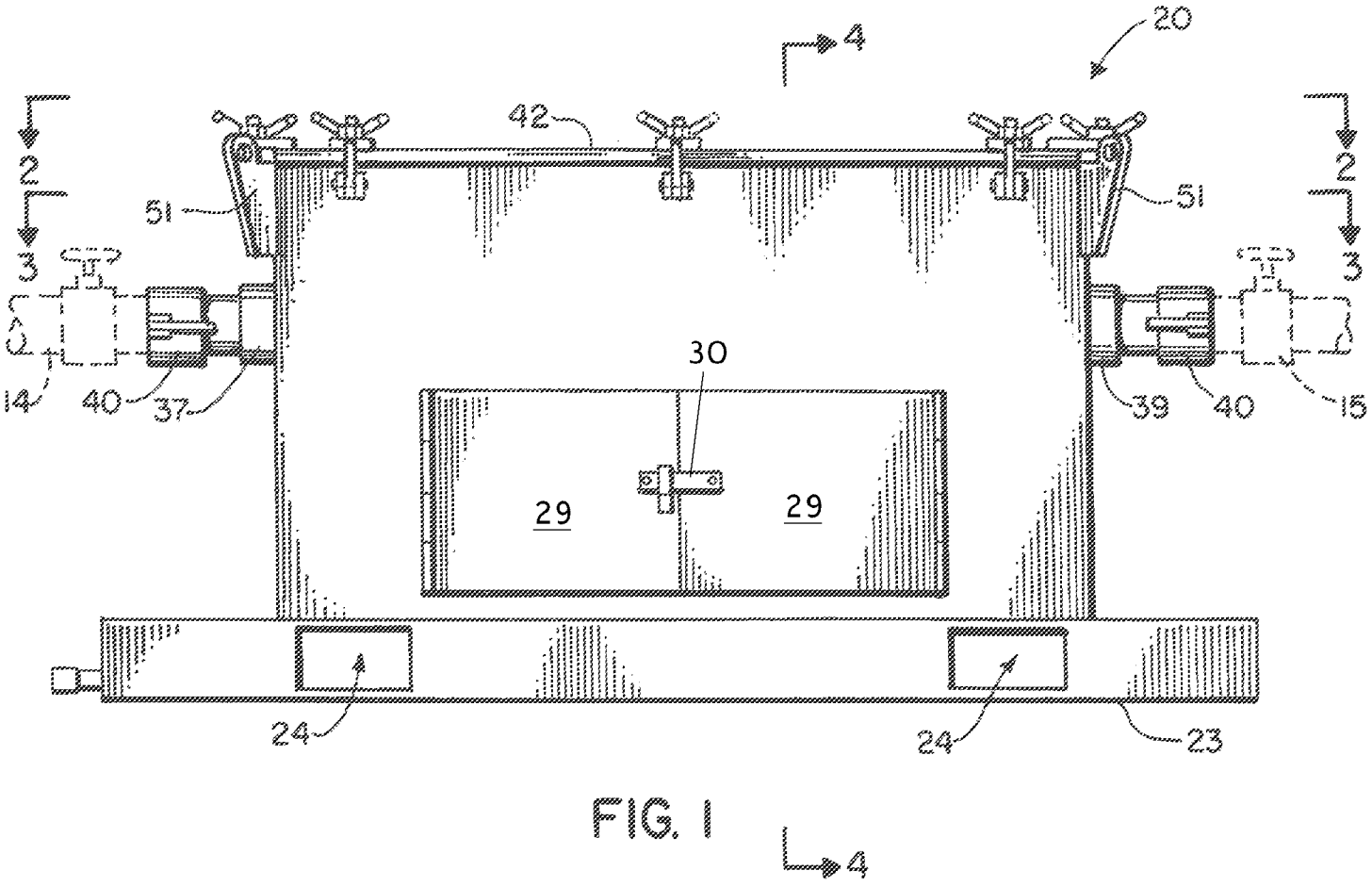
FIG. 1 is an elevation view of the preferred embodiment of the apparatus of the present invention.
Figure 2:
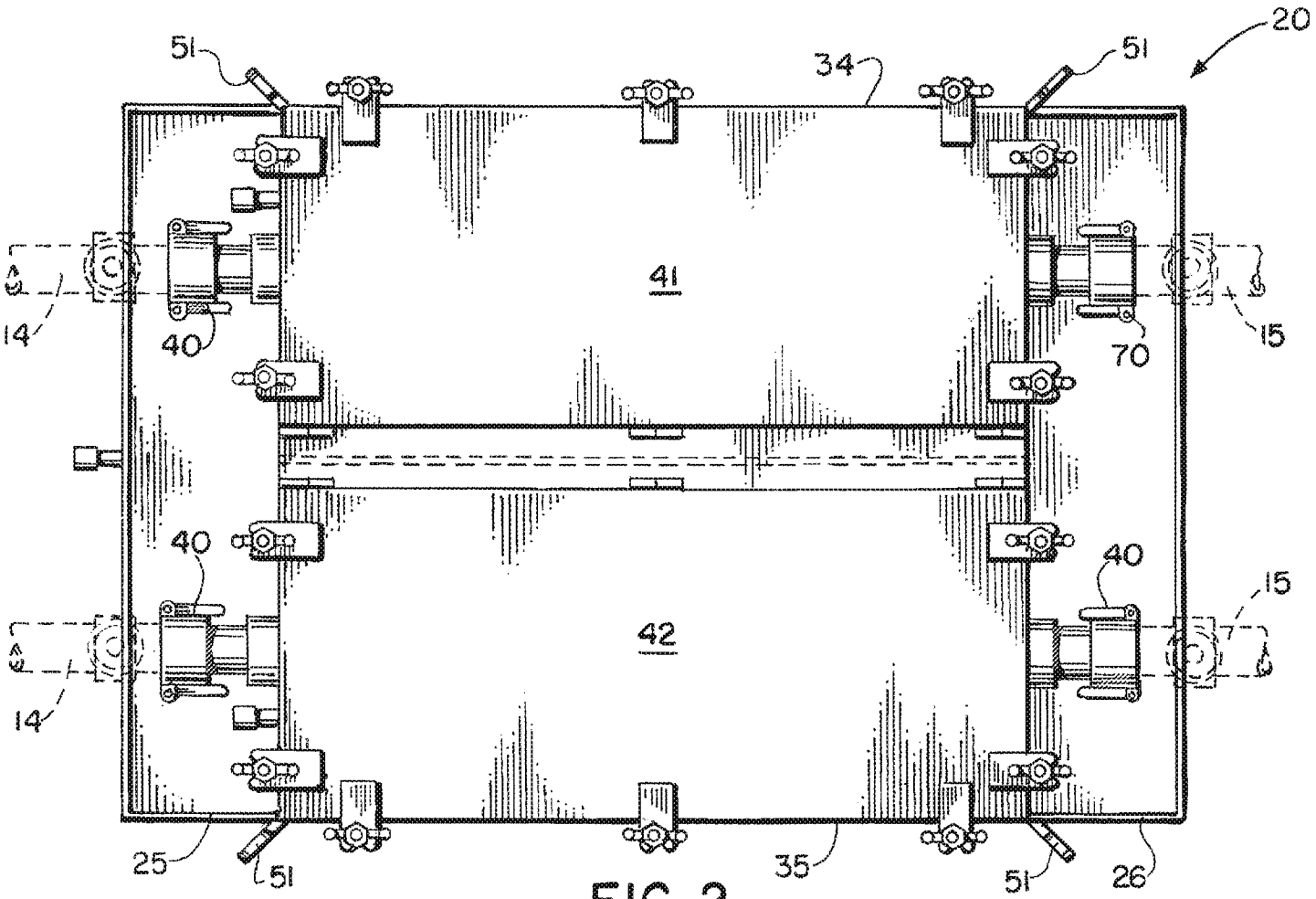
FIG. 2 is a plan view of the preferred embodiment of the apparatus of the present invention taken along lines 2-2 of FIG. 1.
Figure 3:
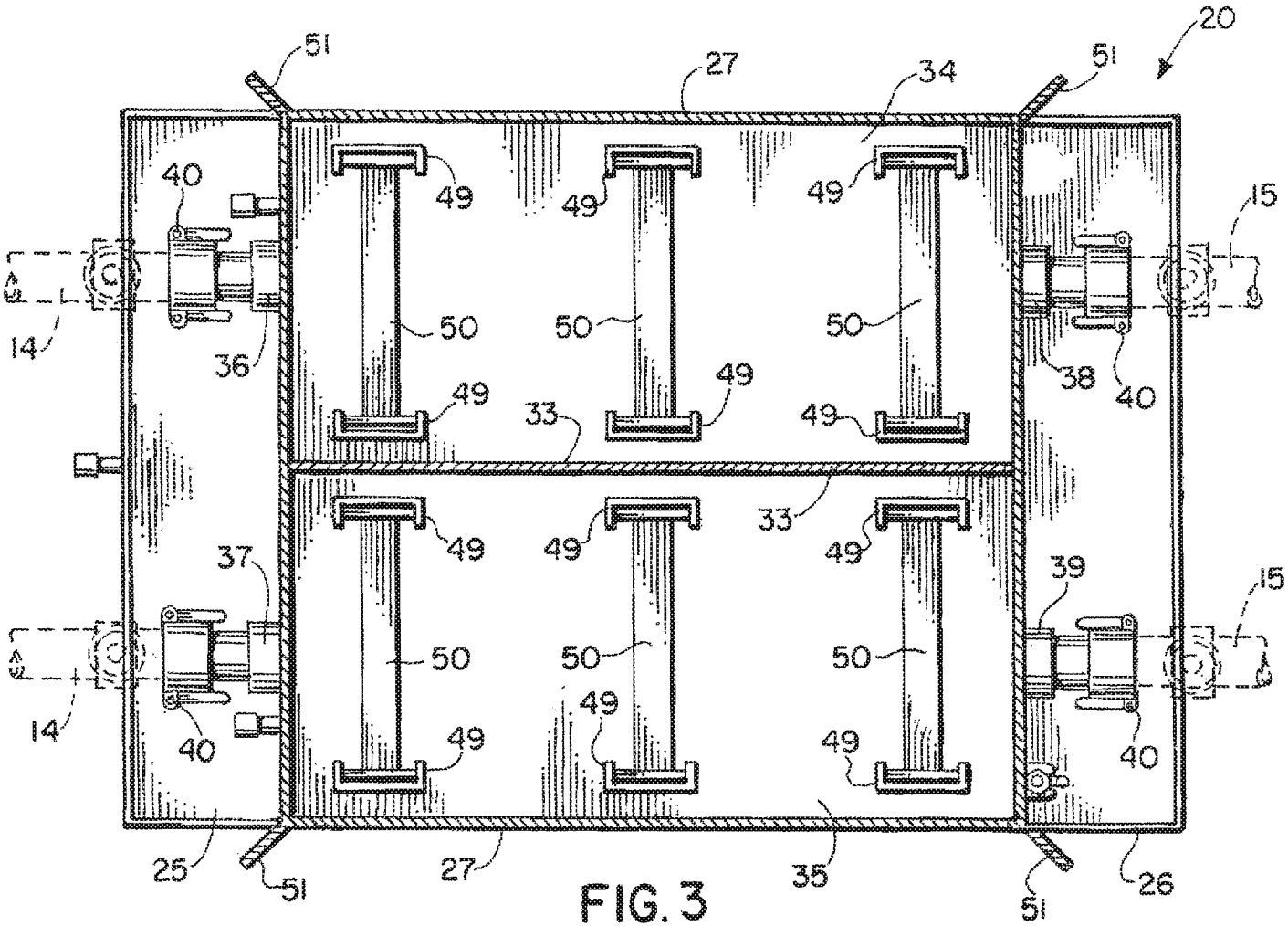
FIG. 3 is a sectional view of the preferred embodiment of the apparatus of the present invention taken along lines 3-3 of FIG. 1.
Figure 4:
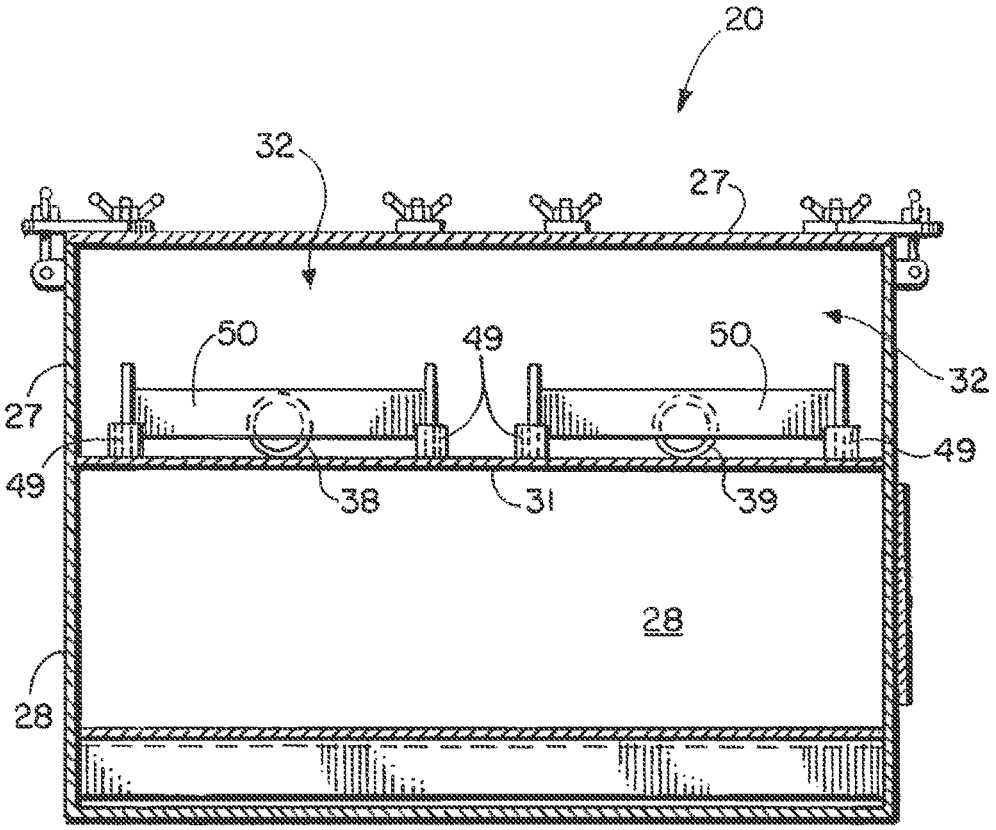
FIG. 4 is a sectional perspective view of the preferred embodiment of the apparatus of the present invention taken along lines 4-4 of FIG. 1.
Figure 5:
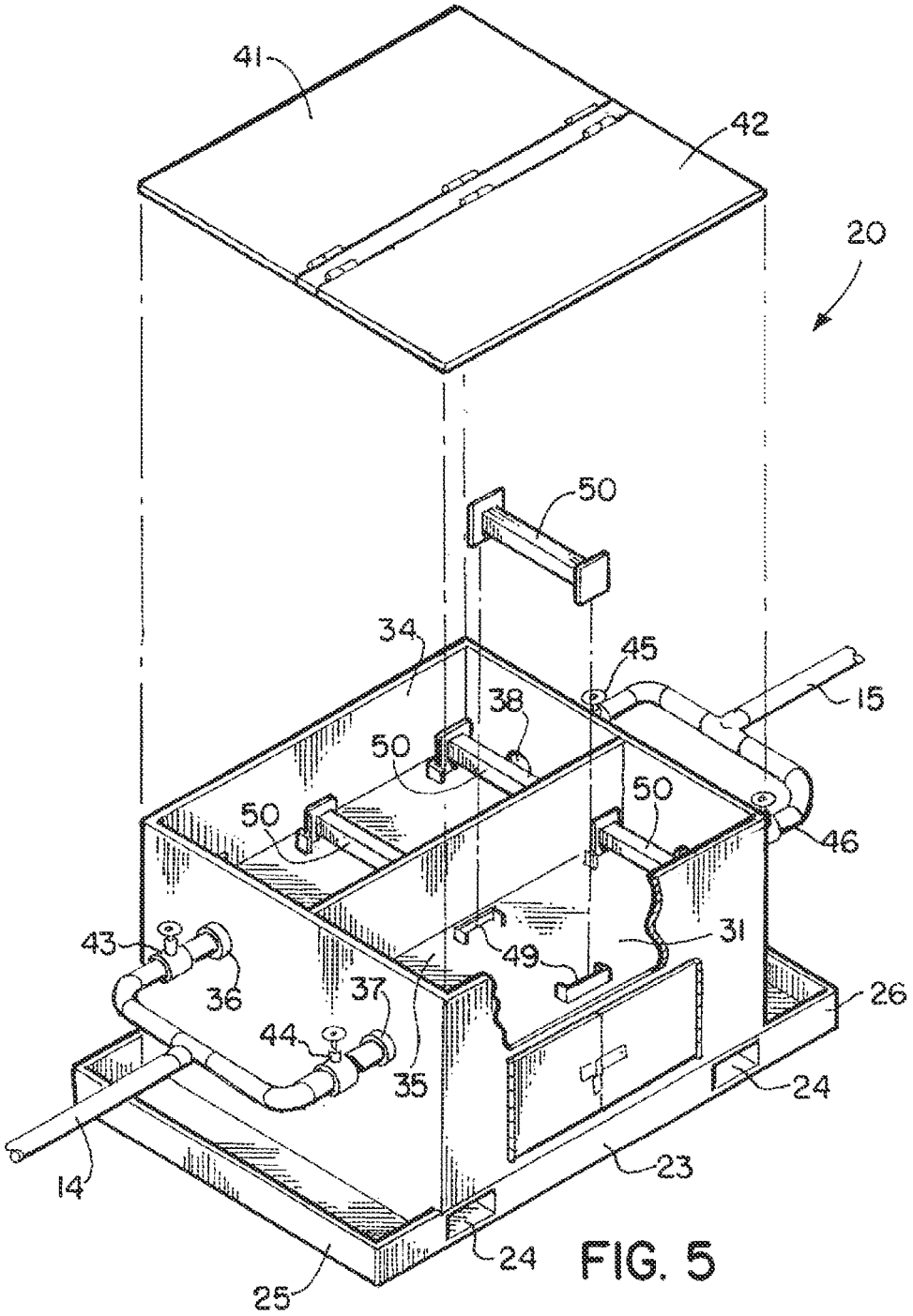
FIG. 5 is a fragmentary perspective view of the preferred embodiment of the apparatus of the present invention.

FIGS. 1-6 show the preferred embodiment of the apparatus of the present invention designated generally by the numeral 10. The system 10 for removing metallic particles from an oil well circulating fluid stream employs a specially configured treatment vessel 20 having a pair of fluid flow sections 34, 35. Each of the sections 34, 35 is equipped with a magnetic field that removes metallic materials as they flow through the section 34 or 35.

Figure 6:
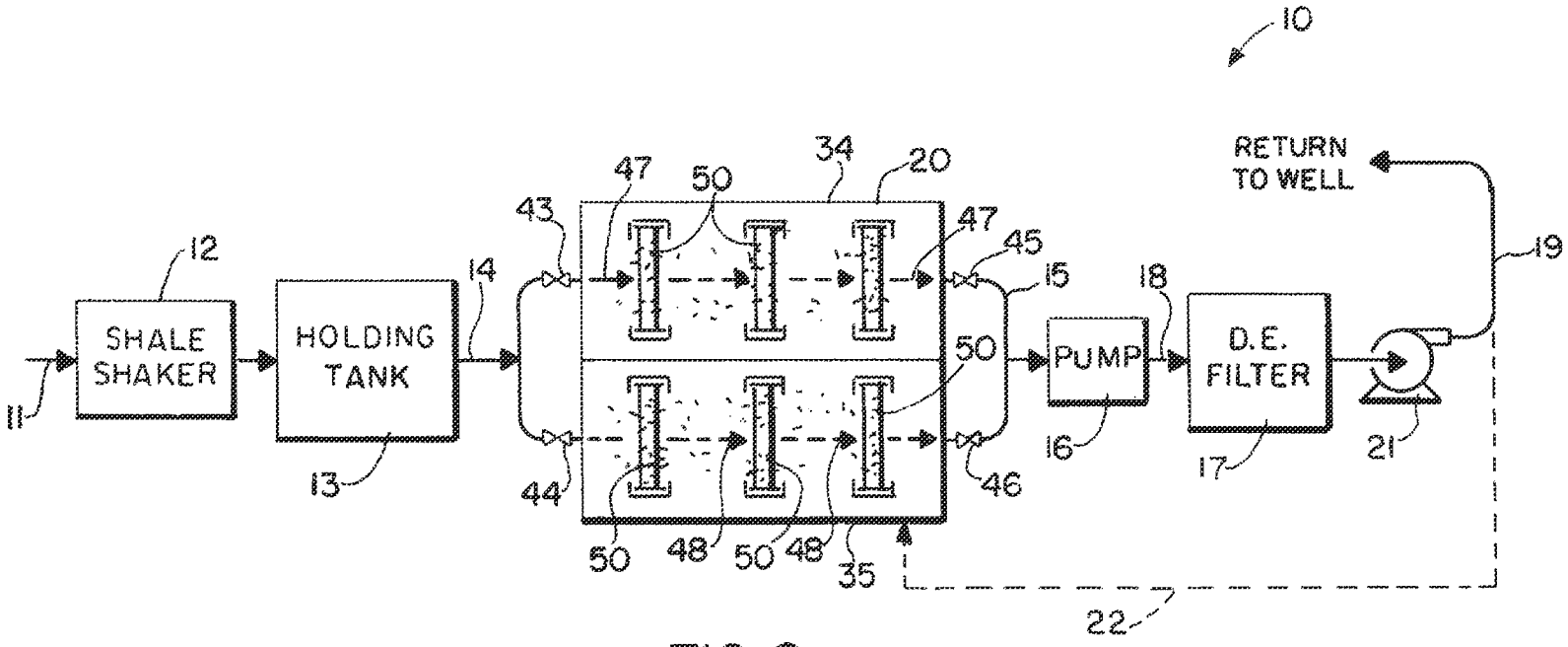
FIG. 6 is a flow diagram of the preferred embodiment of the apparatus of the present invention.
Figure 7:
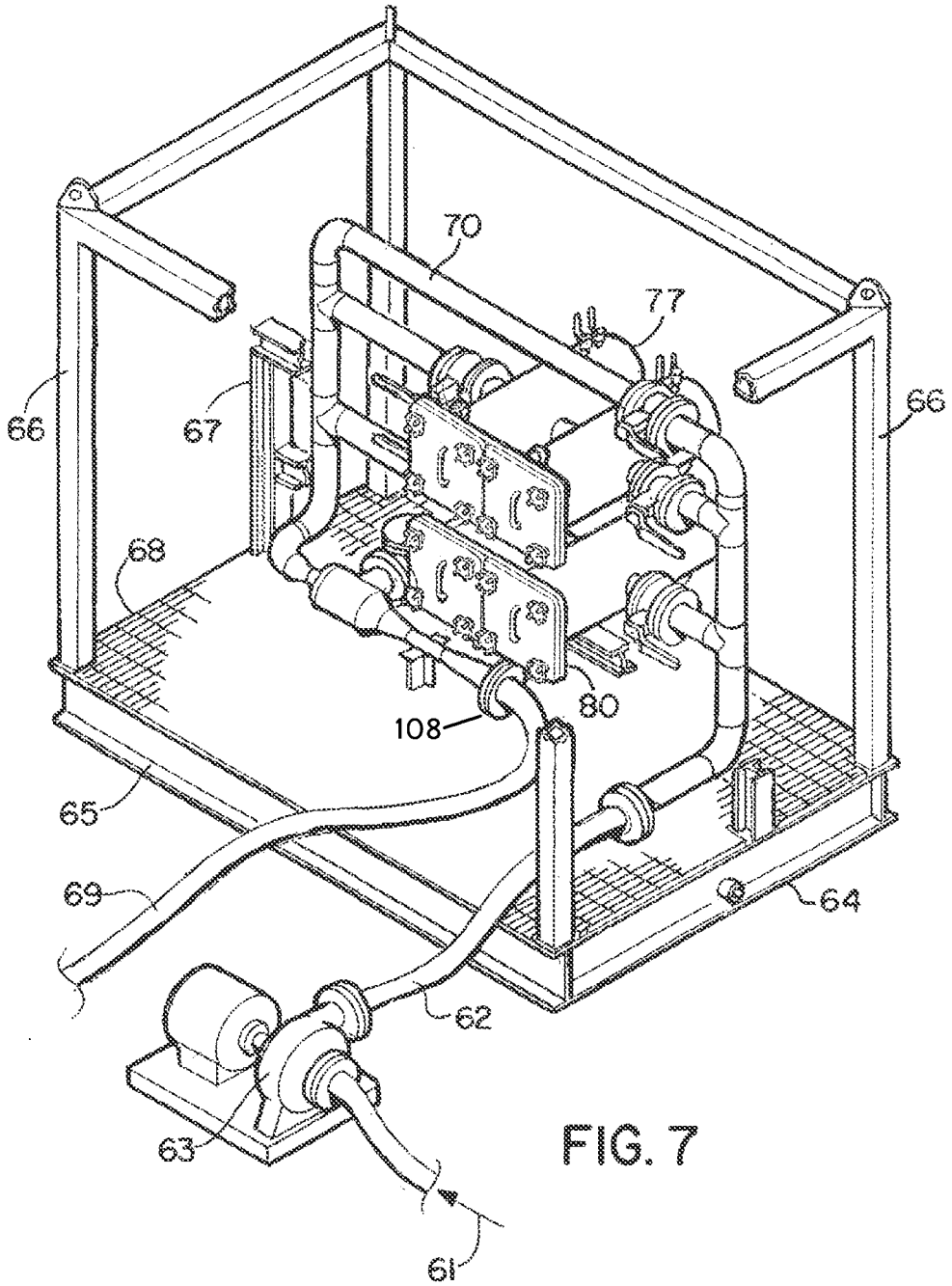
FIG. 7 is a perspective view of a second embodiment of the apparatus of the present invention.

FIG. 6 illustrates the method and apparatus of the present invention, designated generally by the numeral 10. In FIG. 6, the influent flow stream 11 from an oil well can be routed to an initial treatment vessel such as shale shaker 12. Flow stream 11 can be any circulating well fluid, e.g. completion fluid. After exiting shale shaker 12, the fluid enters a holding tank 13. An influent manifold 14 communicates between holding tank 13 and treatment vessel 20. Fluid is transmitted via effluent manifold 15 from treatment vessel 20 to pump 16. The pump 16 transfers fluid received from treatment vessel 20 to a filter 17 which can be a diatomaceous earth or "D.E." filter. Flow line 18 connects pump 16 to diatomaceous earth filter 17.

Effluent flow line 19 returns circulating fluid from filter 17 to the well. Pump 21 can be used to pump fluid that is discharged from filter 17 back into the well. A bypass flow line 22 can be provided to return fluid to treatment vessel 20 so that it can be again treated before returning it to the well if desired.

Treatment vessel 20 provides a base 23 having a pair of spaced apart forklift sockets 24. Base 23 provides influent and effluent drip pans 25, 26. Treatment vessel upper section 27 is a fluid holding section that is divided into fluid sections 34, 35. Treatment vessel lower section 28 is a dry section having access doors 29 and latch 30. The lower section 28 can be used to house components such as manifolds 14, 15. Horizontal plate or floor 31 separates upper and lower sections 27, 28. The upper section 27 provides a fluid containing space 32 that is divided longitudinally by baffle 33. Padeyes 51 enable vessel 20 to be lifted with slings and/or like rigging and a crane.

Each of the fluid sections 34, 35 includes an influent flow line and an effluent flow line. Fluid section 34 has influent flow line 36 and effluent flow line 38. Fluid section 35 has influent flow line 37 and effluent flow line 39.

Quick connect fittings such as cam lock fittings can be used to attach each manifold 14, 15 to treatment vessel 20. In the drawings, the numeral 40 is used to designate such cam lock or quick connect fittings, which are commercially available fittings. Drip pans 25, 26 are positioned to catch any drips/leakage from quick connect fittings 40 or influents or effluents 36, 37, 38, 39.

In order to gain access to the vessel 20 interior space 32, a pair of lids 41, 42 are provided. The lid 41 enables access to fluid section 34. The lid 42 enables access to fluid section 35.

In FIG. 6, a plurality of valves 43-46 are provided. Valve 43 is an influent valve that controls the flow of fluid from holding tank 13 to section 34 of vessel 20 via manifold 14. Valve 44 is an inlet valve that controls the flow of fluid from holding tank 13 to section 35 via manifold 14. Valves 45 and 46 control effluent flow via manifold 15 to pump 16 and then to diatomaceous earth filter 17. Valve 45 controls effluent from section 34 in manifold 15. Valve 46 controls effluent flow from section 35 in manifold 15.

Flow arrows 47 indicate the direction of flow of fluid in section 34. Similarly, arrows 48 indicate the direction of flow in section 35.

Each of the sections 34 and 35 has a magnetic field. The magnetic field for section 34 can be in the form of a plurality of magnets 50. Similarly, the magnetic field in section 35 can be a plurality of magnets 50. Each of the magnets 50 is secured to vessel 20 using mounts such as channels 49. The channels 49 can be of a non-magnetic material so that magnets 50 can be easily removed for cleaning purposes.

The method of the present invention contemplates fluid flow through only one section 34 or 35 at a time. In order to flow fluid through section 34, the valves 44 and 46 are closed and the valve 43 and 45 are open.

After a period of time, the magnets 50 (or magnetic field) will accumulate metallic material and will need to be cleaned. In order to clean the magnets 50 of one section (such as section 34), valves 44 and 46 are opened. After the valves 44 and 46 are opened, the valves 43 and 45 are closed so that fluid only flows in section 35.

A user then opens the section 34 by raising its lid 41 to gain access to the magnets 50 in section 34. The magnets 50 are removed from the section 34. The magnets 50 are then cleaned of metallic material that has adhered to the magnet 50. This can be accomplished by scraping the metallic material from the surface of the magnet 50.

If an electromagnet is employed, an electrical control can be used to shut down the magnetic field and discharge metallic material from the magnet 50 such as cuttings, debris or other metallic material. The present invention enables metal, iron, iron oxide, metal cuttings and the like to be removed from the flow stream that is flowing from the well and into the preliminary treatment vessel or shale shaker 12.

When operating the apparatus 10 of the present invention and the method of the present invention, user's will quickly learn from experience how often they need to change or clean the magnets 50 depending upon the concentration of metallic material being removed. For example, the magnets 50 could initially be checked every five minutes until a heavy accumulation of metal is observed. An operator will thus learn that a period of time passes before a heavy accumulation of metallic material occurs. This time period could be fifteen minutes, a half hour, two hours or the like. Once the proper time interval has been learned through experience, the magnetic members 50 need not be checked as often.

Figure 12:
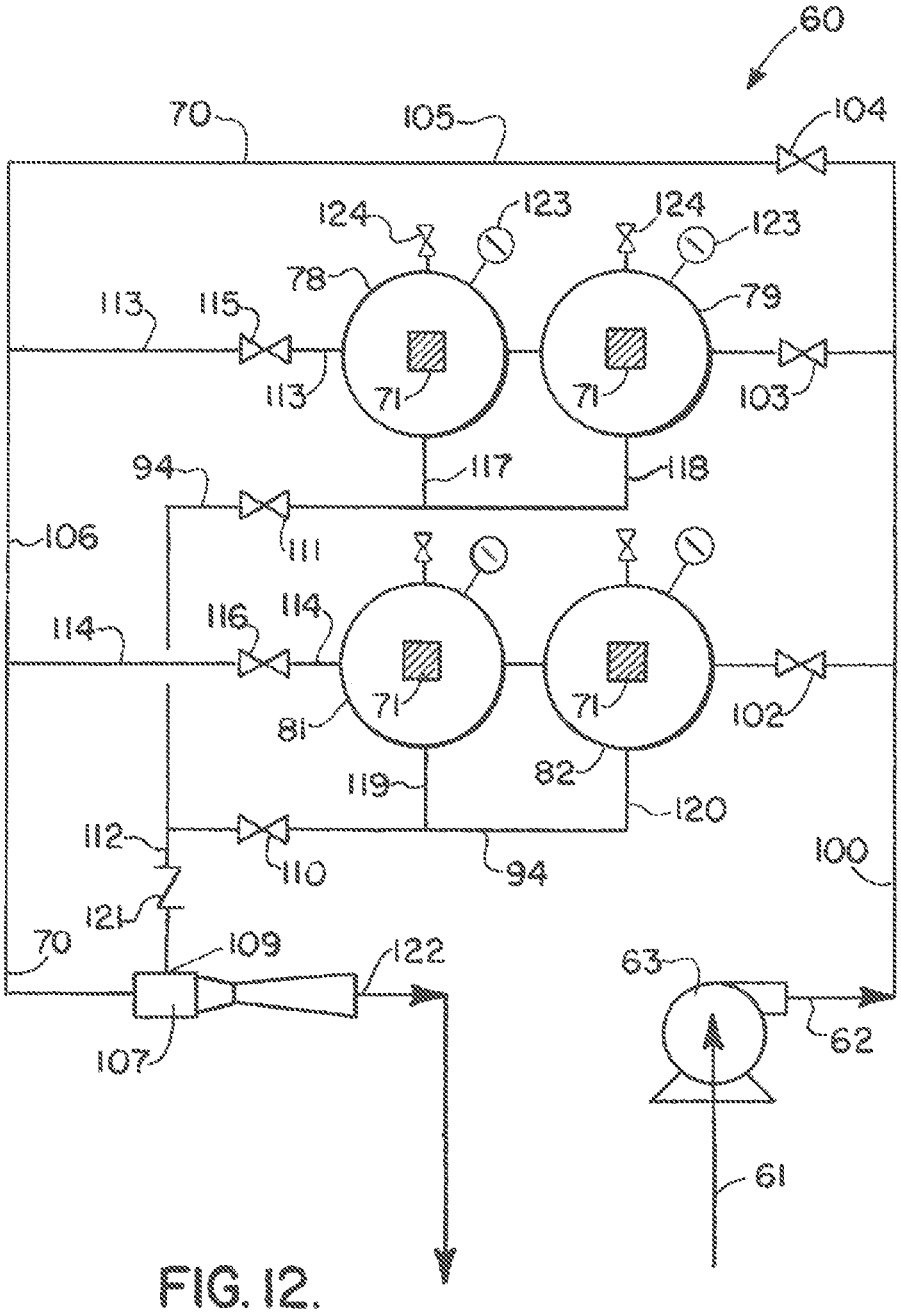
FIG. 12 is a flow diagram of the second embodiment of the apparatus of the present invention.
Figure 13:
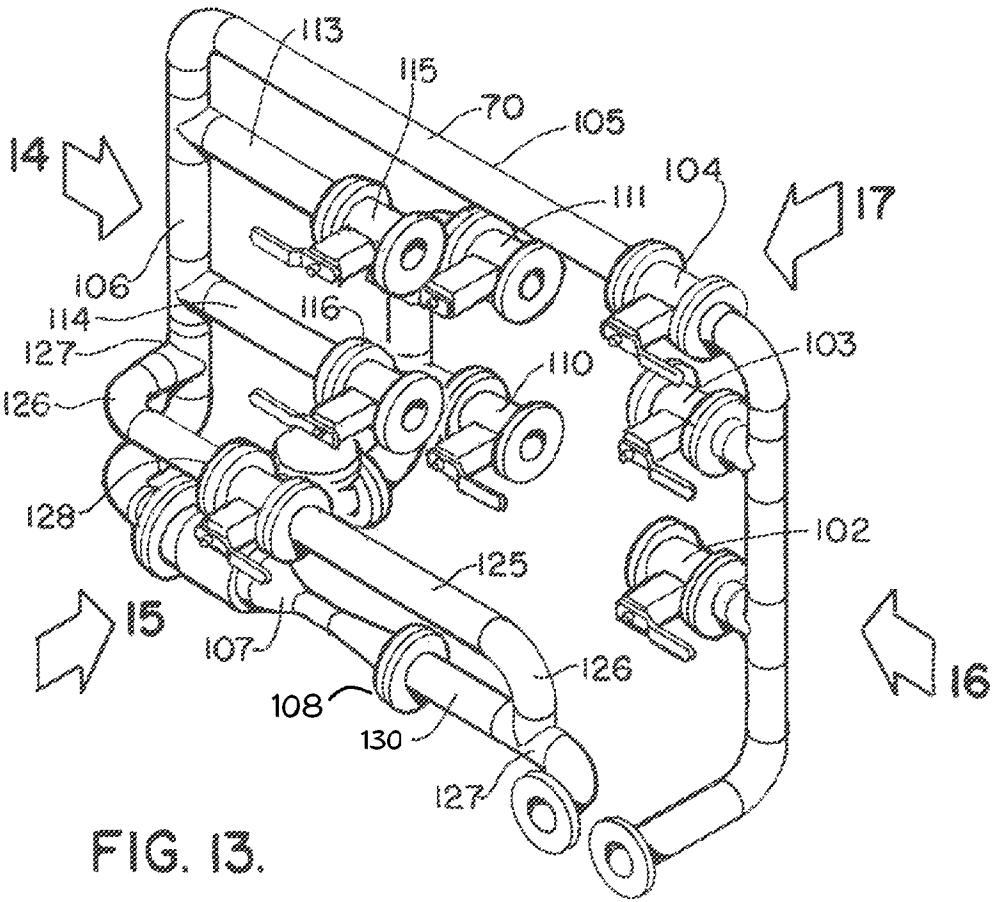
FIG. 13 is a perspective view of the second embodiment of the apparatus of the present invention.
Figure 14:
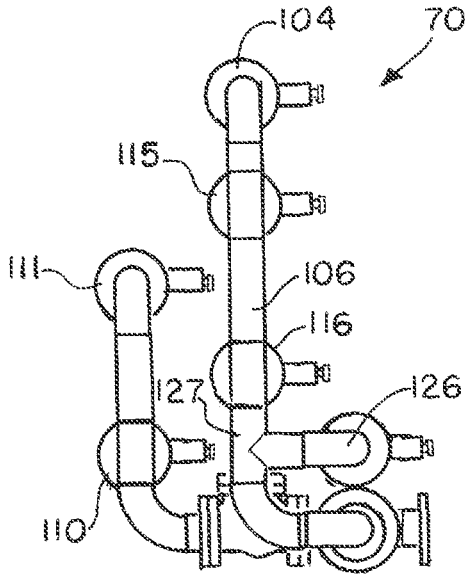
FIG. 14 is an end view of the second embodiment of the apparatus of the present invention.
Figure 15:
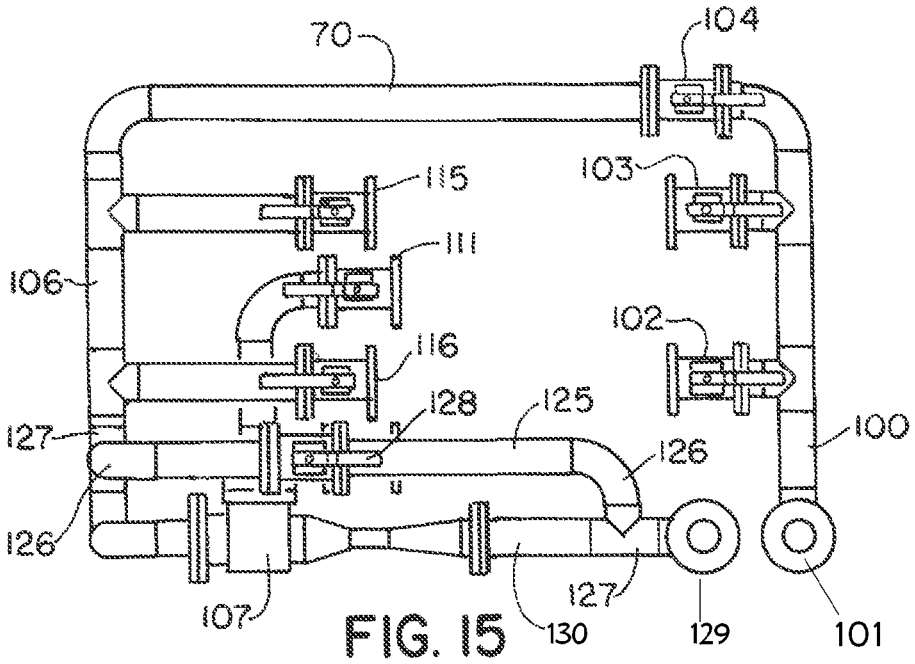
FIG. 15 is an elevation view of the second embodiment of the apparatus of the present invention.
Figure 16:
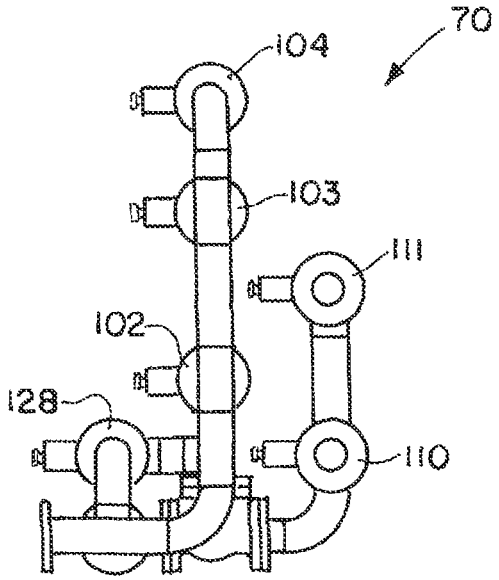
FIG. 16 is an end view of the second embodiment of the apparatus of the present invention.
Figure 17:
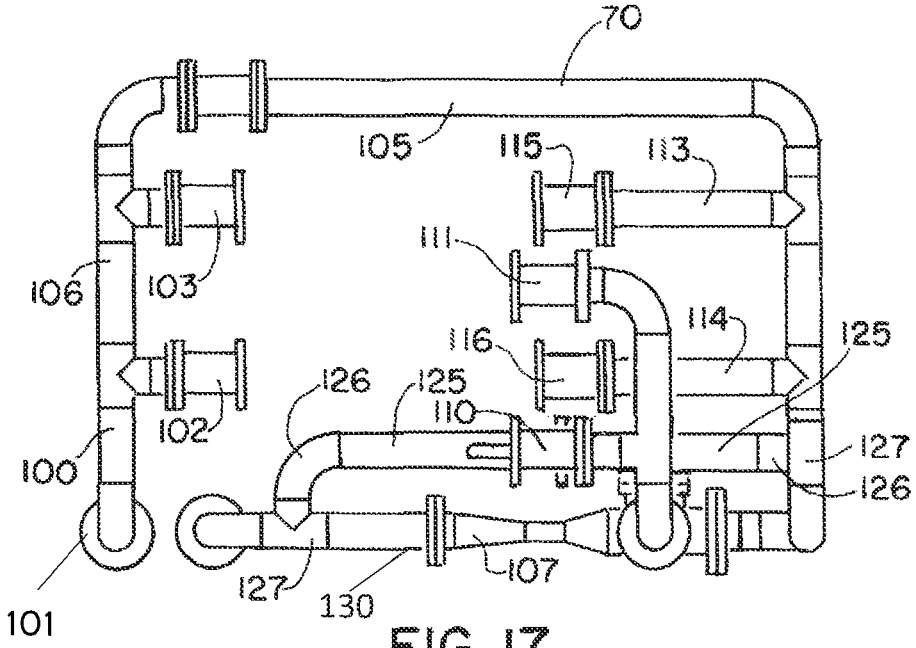
FIG. 17 is a rear view of the second embodiment of the apparatus of the present invention.
Figure 18:
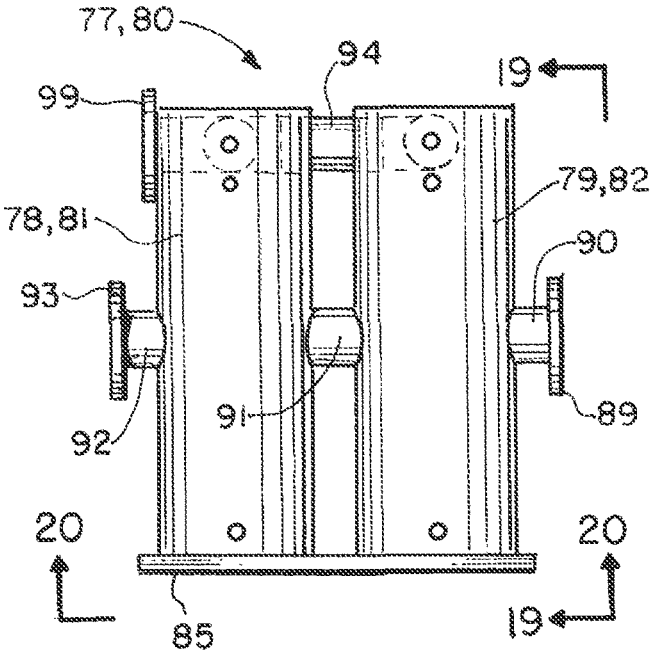
FIG. 18 is a fragmentary view of the second embodiment of the apparatus of the present invention.
Figure 19:
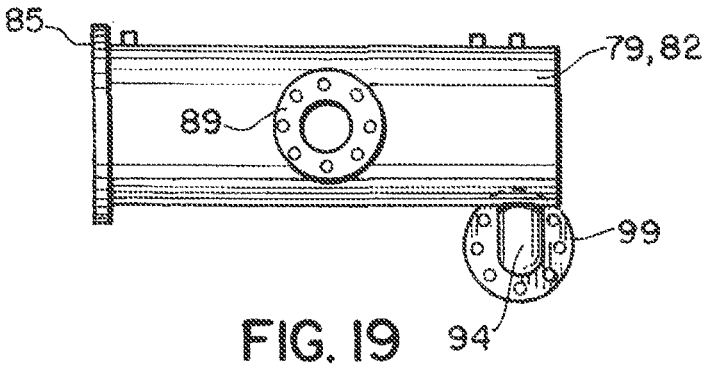
FIG. 19 is a fragmentary view of the second embodiment of the apparatus of the present invention.
Figure 20:
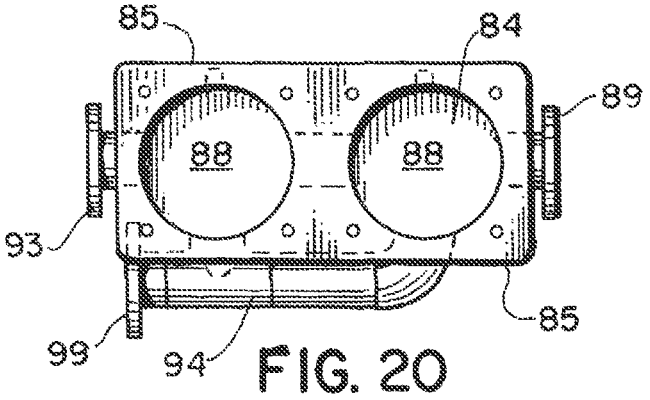
FIG. 20 is a fragmentary view of the second embodiment of the apparatus of the present invention.

FIGS. 7-20 show an alternate embodiment of the apparatus of the present invention designated generally by the numeral 60 in FIG. 12. The system 60 for removing metallic material from an oil well circulating fluid can be a pressurized system. The system 60 receives influent 61 from an oil well which is transmitted through a pump 63 to an influent flow line 62 and then to manifold 70. Manifold 70 can have an influent or inlet flange 101 and an effluent or outlet flange 129. The manifold 70 together with its canisters and valves can be supported upon a transportable frame 64. Frame 64 has a base 65 that can include multiple welded beams to form a substructure 66 that can be covered with decking 68 such as metal grating. One or more pipe supports 67 can be provided as part of base 65 for supporting various portions of the manifold 70 and/or its component parts. FIGS. 13-17 show manifold 70 with canisters 78, 79, 81, 82 removed.

Effluent flow line 69 is discharged from manifold 70. It should be understood that the transportable frame 64, its manifold 70, and the various component parts described hereinafter can be used a part of an overall system for removing metallic material from an oil well circulating fluid similar to that shown and described in FIG. 6. Whereas the embodiment of FIG. 6 does not show a pump in between the holding tank 13 and the manifold 14, the manifold 70 and its transportable frame 64 could provide a pump 63 in between the holding tank 13 and the manifold 70, its canisters and its components.

The manifold 70 supports a number of canister assemblies including an upper canister 77 and a lower canister assembly 80. Each of the canister assemblies includes a pair of canisters. The upper canister assembly 77 has canisters 78 and 79. The lower canister assembly 80 has canisters 81 and 82. Each of the canisters 78, 79, 81, 82 has a magnet 71 (see FIGS. 8-12) that can be used to remove metallic material from an oil well circulating fluid that flows through the manifold 70 as will be described more fully hereinafter. Each magnet 71 can thus be removed from its canister 78, 79, 81, 82 when metallic particles are to be removed from the magnets 71.

In order to remove a magnet 71 from a canister 78, 79, 81, 82 there is provided a handle 72 attached to closure plate 73. Each magnet 71 can be provided with a wiper 74. The wiper 74 can be used to slide along the length of the magnet 71 pushing all of the metallic materials that have accumulated upon the magnet 71 to an end portion of the magnet 71. The magnetic material that is to be removed can then be scraped from the magnet 71 or otherwise disposed of. One end portion of the magnet can connect to a non-metallic section so that when the wiper pushes metallic material to the non-metallic section the collected metallic material falls off.

Figure 9:
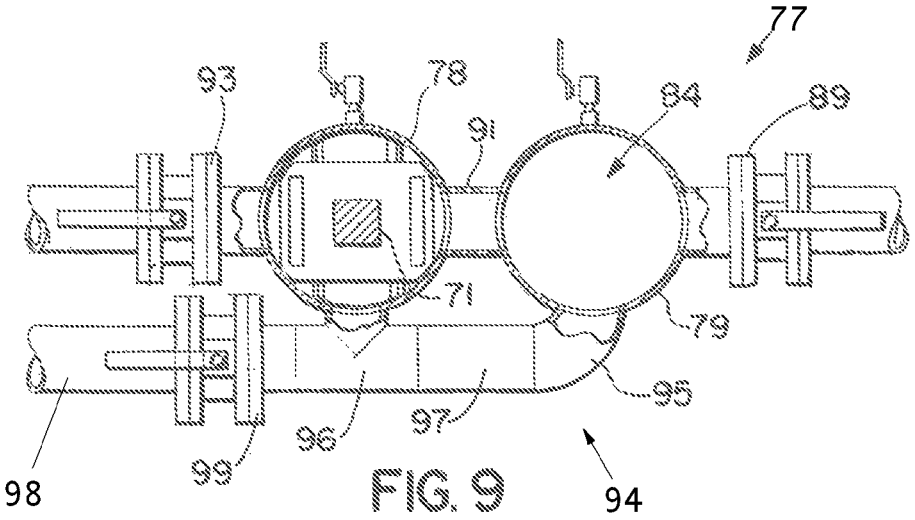
FIG. 9 is a fragmentary sectional view of the second embodiment of the apparatus of the present invention taken along 9-9 of FIG. 8.
Figure 10:
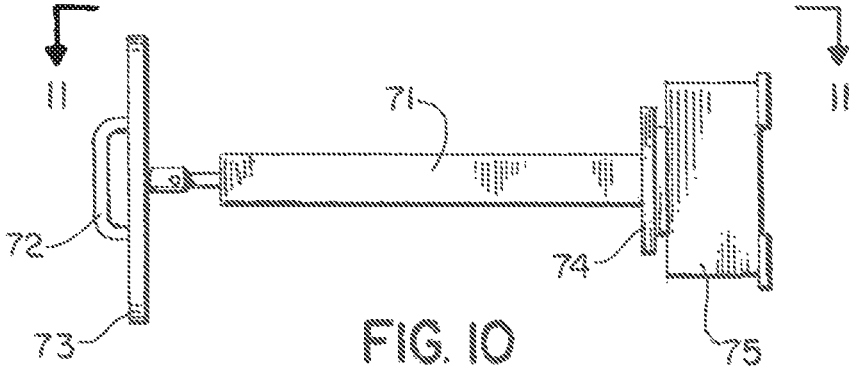
FIG. 10 is a partial plan view of the second embodiment of the apparatus of the present invention.
Figure 11:
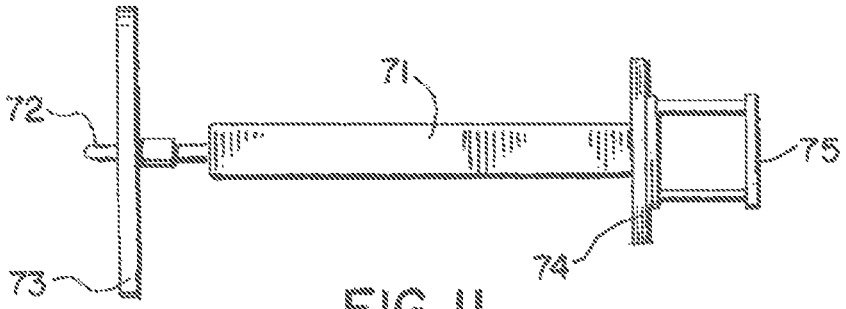
FIG. 11 is a sectional view taken along lines 11-11 of FIG. 10.

Each magnet 71 has an end support 75 opposite closure plate 73. The combination of closure plate 73 and end plate or end support 75 holds the magnets 71 at the central portion of a canister 78, 79, 81, 82 as seen in FIGS. 9 and 12.

Each canister 78, 79, 81, 82 has an open end 83 and an interior 84 for holding a magnet 71. Flange 85 defines the open end portion of two canisters such as the canisters 78, 79 or canisters 81, 82.

Figure 8:
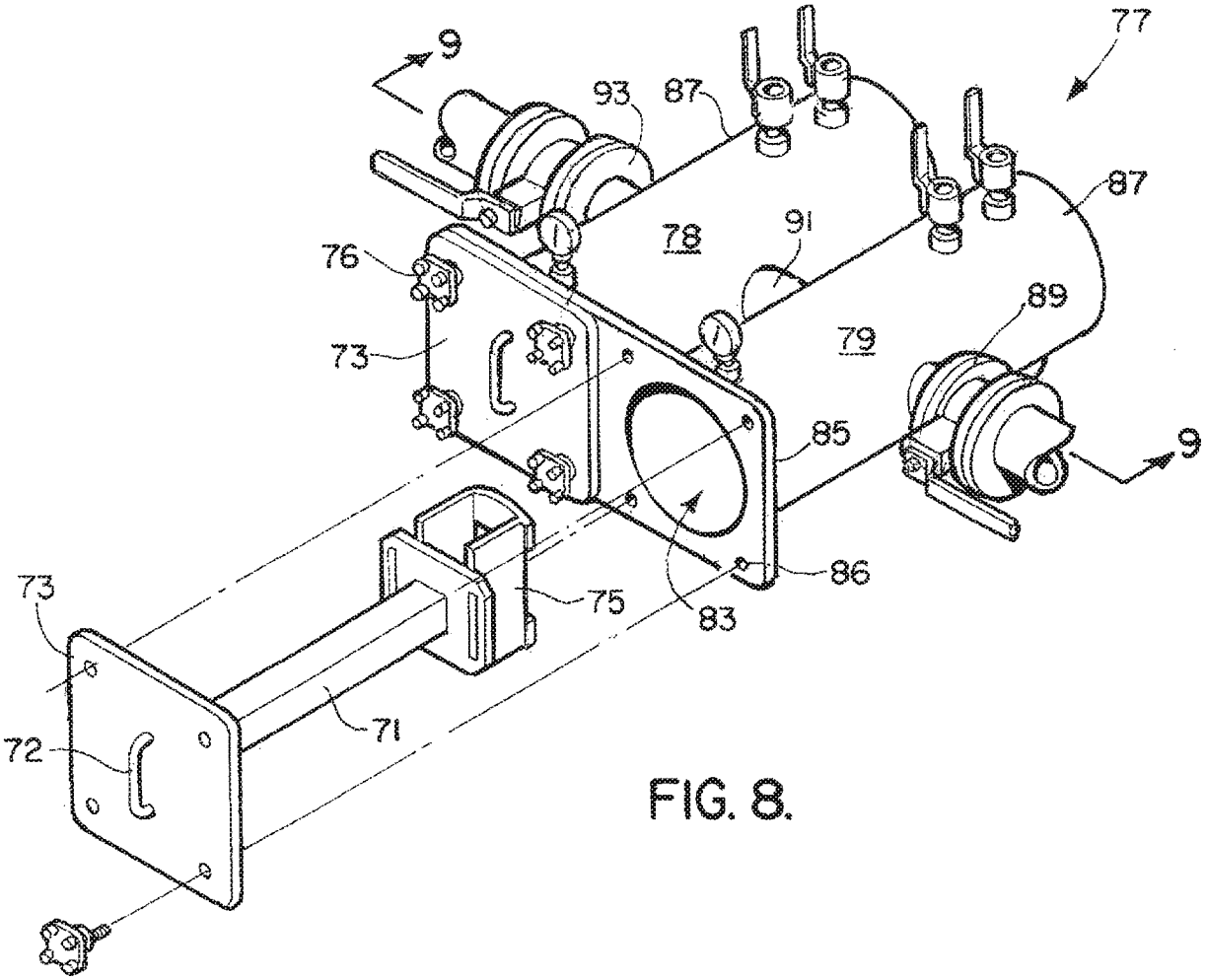
FIG. 8 is fragmentary perspective exploded view of the second embodiment of the apparatus of the present invention.

Each flange 85 has flange openings 86 that enable a bolted connection to be made between the flange 85 and a closure plate 73. Bolts or bolted connection 76 can be used to attach each closure plate 73 to flange 85 at flange openings 86 as shown in FIG. 8.

Each canister 78, 79, 81, 82 can be in the form of a cylindrical wall 87, closed at one end that is opposite flange 85 with circular end wall 88.

Each canister assembly 77, 80 is equipped with piping, valves, and flanges that enable fluid to flow through the upper canister 77 or through the lower canister assembly so that the circulating fluid can be subjected to a magnetic field (for example, magnet 71) thus removing metallic particles in the fluid stream. Each canister assembly 77, 80 thus has an influent flange 89 connected to flow line 90 which connects to the canister 79. Flow line 91 joins between the canister 78, 79 as shown in FIG. 8. Flow line 92 exits the cannister 78 and connects with effluent flange 93.

For emptying the canisters 78, 79, 81, 82 there is provided a drain line 94 (see FIGS. 9, 12, 18-20). Each drain line 94 can be in the form of an elbow fitting 95, tee-fitting 96, pipe section 97, pipe section 98, and flange 99 as shown in FIG. 9. Before opening any canister assembly 77, 80 it is desirable to first relieve pressure by opening one of the relief valves 124 and then ascertaining that pressure has dropped to an acceptable level by reading pressure gauge 123. Preferably each canister 78, 79, 81, 82 is provided with a pressure gauge 123 and relief valve 124. Fluid is then removed from the canisters using a drain 94.

FIG. 12 illustrates in a schematic diagram, the various fittings and components that comprise manifold 70 and the system of removing metallic material from an oil well circulating fluid. Riser flow line 100 receives flow from influent flow lines 61, 62 as shown. The riser flow line 100 enables fluid to bypass the upper and lower canister assemblies 77, 80 by closing valves 102 and 103 and opening valve 104. An influent flange 101 enables an influent flow line 62 such as a hose to be connected to riser flow line 100.

Downstream of valve 104 there is provided a horizontal pipe section 105 which communicates with riser flow line 106. The riser flow line 106 provides an influent for eductor pump 107. The eductor pump 107 has a pump outlet flange 108 and a pump suction line 109 that receives flow from the drains 94 and thus from the upper and lower canister assembly 77, 80. The drain lines 94 can be controlled with valves 110, 111. Draining fluid from upper canister assembly 77 can be achieved by opening valve 111 thus enabling flow to exit canister 78, 79 via flow line 117, 118. Similarly, drain line 94 can be drained via valve 110 and drain lines 119, 120. Check valve 121 can be placed in drain line 112 above pump 107.

In FIGS. 14-17, bypass 125 flow line enables fluid to bypass pump 107. Bypass flow line 125 can include an elbow fitting 126 and tee fitting 127 upstream of closure valve 128. The tee fitting 127 is placed in line in riser flow line 106 below lower canister assembly 80. Another elbow fitting 126 and tee fitting 127 are placed in line in pump discharge flow line 130. Valve 128 is closed if flow is to be through pump 107. Valve 128 is opened if flow is to bypass pump 107.

If either of the valves 110 or 111 is opened, the eductor pump 107 suctions liquid via line 112 and through check valve 121. The eductor pump 107 then mixes that drained fluid received through flow line 112 with the flow traveling through riser 106 and being discharged at pump discharge 112. The eductor pump 107 can for example, be a commercially available eductor type pump. When the valves 104, 111,110 are closed, flow from pump 63 and influent flow line 62 enter upper canister assembly 77 via valve 103 and lower canister assembly 80 via valve 102. Alternatively, either one of the valves 102, 103 can be closed so that only one of the canister assemblies receives flow from influent flow line 62.

When flow is to be transmitted from influent flow line 62 through either one of or both of the upper or lower canister assemblies 77, 80 valves 115, 116 are opened. For example, if flow is to be only through upper canister 77, valves 103, 115 are opened and the valves 104, 102 are closed. Likewise, the drain valves 111, 110 are closed.

If flow is to be simultaneously through the upper canister assembly 77 and the lower canister assembly 80, the valves 104, 110, 111 are closed and the valves 102, 103, 115, 116 are opened.

In order to clean the upper canister assembly 77 and its magnets 71, the valves 103, 104, 115 are closed. Initially, the valves 110, 111 are also closed. The valves 102, 116 are opened. The relief valves 124 associated with each of the upper canisters 78, 79 are opened to remove any pressure in canisters 78 and 79. Pressure gauges 123 on these canisters 78, 79 are viewed to ensure that the pressure has dropped to atmospheric. The user then removes the bolts 76 that secure each magnet 71 and its closure plate 73 to the flange 85. Handle 72 is used to pull the magnet 71 from its canister. When the magnets 71 of each of the canisters 78, 79 had been cleaned of debris, metallic particles and the like, the magnets 71 and their closure plate 73 are returned to the canister 78, 79 and secured with bolts 76. Valves 103, 115 can then be opened. A user can then service the lower canister assembly 80 by closing the valves 102, 116 and repeating the procedure that was used to clean the magnets 71 of the upper canister 77.

The following is a list of parts and materials suitable for use in the present invention.

PARTS LIST

| Part Number | Description |
|---|---|
| 10 | system for removing metallic material from an oil well circulating fluid |
| 11 | influent flow from well |
| 12 | shale shaker |
| 13 | holding tank |
| 14 | influent manifold |
| 15 | effluent manifold |
| 16 | pump |
| 17 | diatomaceous earth filter |
| 18 | flow line |
| 19 | effluent flow line |
| 20 | treatment vessel |
| 21 | pump |
| 22 | bypass flow line |
| 23 | base |
| 24 | fork lift socket |
| 25 | drip pan |
| 26 | drip pan |
| 27 | upper section |
| 28 | lower section |
| 29 | access doors |
| 30 | latch |
| 31 | horizontal plate/floor |
| 32 | fluid holding interior space |
| 33 | longitudinal baffle |
| 34 | fluid section |
| 35 | fluid section |
| 36 | influent flow line |
| 37 | influent flow line |
| 38 | effluent flow line |
| 39 | effluent flow line |
| 40 | quick connect fitting |
| 41 | lid |
| 42 | lid |
| 43 | valve |
| 44 | valve |
| 45 | valve |
| 46 | valve |
| 47 | arrow |
| 48 | arrow |
| 49 | channel |
| 50 | magnet |

-continued

PARTS LIST

| Part Number | Description |
|---|---|
| 51 | padeye |
| 60 | system for removing metallic material from an oil well circulating fluid |
| 61 | influent from well |
| 62 | influent flow line |
| 63 | pump |
| 64 | transportable frame |
| 65 | base |
| 66 | superstructure |
| 67 | piping support |
| 68 | decking |
| 69 | effluent flow line |
| 70 | manifold |
| 71 | magnet |
| 72 | handle |
| 73 | closure plate |
| 74 | wiper |
| 75 | end support |
| 76 | bolt |
| 77 | upper canister assembly |
| 78 | upper canister |
| 79 | upper canister |
| 80 | lower canister assembly |
| 81 | lower canister |
| 82 | lower canister |
| 83 | open end |
| 84 | interior |
| 85 | flange |
| 86 | opening |
| 87 | cylindrical wall |
| 88 | circular end wall |
| 89 | influent flange |
| 90 | flow line |
| 91 | flow line |
| 92 | flow line |
| 93 | effluent flange |
| 94 | drain line |
| 95 | elbow fitting |
| 96 | tee fitting |
| 97 | pipe section |
| 98 | pipe section |
| 99 | flange |
| 100 | riser flow line |
| 101 | flange |
| 102 | valve |
| 103 | valve |
| 104 | valve |
| 105 | horizontal pipe section |
| 106 | riser flow line |
| 107 | eductor pump |
| 108 | pump outlet flange |
| 109 | pump suction line |
| 110 | valve |
| 111 | valve |
| 112 | drain line |
| 113 | canister discharge line |
| 114 | canister discharge line |
| 115 | valve |
| 116 | valve |
| 117 | drain |
| 118 | drain |
| 119 | drain |
| 120 | drain |
| 121 | check valve |
| 122 | pump discharge |
| 123 | pressure gauge |
| 124 | relief valve |
| 125 | bypass flow line |
| 126 | elbow fitting |
| 127 | tee fitting |
| 128 | valve |
| 129 | outlet flange |
| 130 | discharge flow line |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A method of removing metal cuttings from an oil well circulating fluid stream that includes a well fluids flow stream coming from the well and a well fluids flow stream flowing into the well comprising the steps of:

a) providing a pressurized piping system that includes canisters and piping, said system holding multiple magnetized bars, said system having first and second sections each said section having a canister;

b) placing the magnetized bars in the oil well circulating fluid stream, wherein at least one of said magnetized bars is located in a canister of each of the first and second sections;

c) flowing the oil well circulating fluid stream through an influent flow line to the first section while allowing metal cuttings to accumulate on the magnetized bars in the first section over time;

d) depressurizing and draining the first section and first section canister;

e) after step "d" removing the magnetized bars from the first section canister of steps "b" and "c";

f) after step "e" removing the metal cuttings from an outer surface of the magnetized bar of the first section;

g) discharging the oil well circulating fluid stream from the first section prior to step "f" via a discharge flow line;

h) switching the oil well circulating fluid stream to the second section after step "g"';

i) enabling a bypass of the oil well circulating fluid stream from the influent flow line to the discharge flow line via a bypass flow line wherein the oil well circulating fluid stream enables a selective bypass of the first or second sections; and j) pumping fluid with a pump that receives flow from the bypass flow line downstream of the first and second sections.

2. The method of claim 1 further comprising disconnecting from the first section before step "g".

3. The method of claim 1 further comprising inflowing fluid to said pressurized system using a manifold.

4. The method of claim 3 wherein the manifold is valved.

5. The method of claim 1 further comprising placing in each section multiple magnets.

6. The method of claim 1 wherein each section has one or more canisters, each canister holding at least one magnet.

7. The method of claim 6 wherein the pump of step "j" is an eductor pump.

8. The method of claim 1 wherein the pressurized system is a manifold that includes canisters and further comprising the step of pressurizing the manifold and canisters.

9. The method of claim 8 wherein each canister contains a magnet.

10. The method of claim 8 further comprising depressurizing the canisters after step "c" and before step "d".

11. The method of claim 1 wherein the pump of step "j" is an eductor pump.

* * * * *